US007048678B2

(12) United States Patent
Harms et al.

(10) Patent No.: US 7,048,678 B2
(45) Date of Patent: May 23, 2006

(54) DUMBBELL HAVING INTERLOCKING COMPONENTS

(75) Inventors: Robert E. Harms, Houston, TX (US); Eugenio Segovia, Jr., Bellville, TX (US)

(73) Assignee: Technical Knockout, Inc., Houston, TX (US)

( * ) Notice: Subject to any disclaimer, the term of this patent is extended or adjusted under 35 U.S.C. 154(b) by 522 days.

(21) Appl. No.: 10/064,166

(22) Filed: Jun. 17, 2002

(65) Prior Publication Data

US 2003/0232705 A1 Dec. 18, 2003

(51) Int. Cl.
*A63B 21/072* (2006.01)

(52) U.S. Cl. ..... 482/107; 482/98; 482/108

(58) Field of Classification Search ..... 482/93, 482/94, 98, 106–109; 403/356
See application file for complete search history.

(56) References Cited

U.S. PATENT DOCUMENTS

| | | | | |
|---|---|---|---|---|
| 1,270,034 | A * | 6/1918 | Krudop | 482/107 |
| 1,326,013 | A * | 12/1919 | Ayd | 482/108 |
| 2,452,458 | A * | 10/1948 | Hahn | 403/24 |
| 3,022,073 | A * | 2/1962 | Miller | 482/106 |
| 3,488,051 | A | 1/1970 | Papistas-Scherer | |
| 4,529,197 | A | 7/1985 | Gogarty | |
| 4,566,690 | A | 1/1986 | Schook | |
| 4,900,017 | A | 2/1990 | Bold | |
| 5,102,124 | A | 4/1992 | Diodati | |
| 5,266,069 | A * | 11/1993 | Thorne | 482/111 |
| 5,484,367 | A | 1/1996 | Martinez | |
| 5,628,716 | A * | 5/1997 | Brice | 482/106 |
| 6,099,443 | A * | 8/2000 | Landfair | 482/108 |
| 6,120,420 | A | 9/2000 | Pearson et al. | |
| 6,224,520 | B1 * | 5/2001 | Hsu | 482/107 |
| D444,516 | S | 7/2001 | Pearson et al. | |
| 6,261,211 | B1 * | 7/2001 | Suarez et al. | 482/107 |
| 6,336,894 | B1 * | 1/2002 | Kestila | 482/99 |
| 2003/0232704 | A1 * | 12/2003 | Bowman et al. | 482/107 |
| 2004/0072662 | A1 * | 4/2004 | Landfair | 482/106 |

FOREIGN PATENT DOCUMENTS

| | | | |
|---|---|---|---|
| FR | 1263930 | * | 5/1961 |
| FR | 2459056 A | * | 2/1981 |
| FR | 2600541 A1 | * | 12/1987 |
| GB | 2397254 A | * | 7/2004 |
| JP | 09299505 A | * | 11/1997 |
| KR | 2002078531 A | * | 10/2002 |

* cited by examiner

OTHER PUBLICATIONS

Iron Grip brochure, First We Reinvented The Wheel. Now, We've Perfected It. Introducing Urethane Coated Weight Plates From Iron Grip. 1998.*

*Primary Examiner*—Stephen K. Cronin
*Assistant Examiner*—Victor K. Hwang
(74) *Attorney, Agent, or Firm*—Malin, Haley & DiMaggio, P.A.

(57) ABSTRACT

An inexpensive to manufacture dumbbell hardware design with secure, tight tolerance, non-rotating weights having a central handle with ends having a geometric shape and a central bore at least part way through each end, a means for securing one or more weights to the handle located at least partially within the central bore, and one or more weights, each including an interior element and a cast resistance, wherein the interior element provides tight tolerance with the handle having a circumference and a generally central void of a shape complementary to the geometric shape of the central handle, wherein the wherein the weights are secured by a locking bolt have corresponding threads with the central bore.

21 Claims, 4 Drawing Sheets

DUMBBELL HAVING INTERLOCKING COMPONENTS

BACKGROUND OF INVENTION

1. Field of the Invention

The present invention relates to weight lifting equipment and more particularly pertains to devices used for weight lifting and weight training, such as barbells and dumbbells. The present invention also relates to weights for weight lifting equipment.

2. Description of Related Art

Prior art dumbbells and barbells consisting of a handle with a weight at either end are well known in the art. In the current popular form, dumbbells and barbells are made by the attachment of discs to either end of the handle. The disks may be permanently attached, unitarily formed to the handle, or they may be attached by locking collars. By using locking collars, a dumbbell becomes unnecessarily wide and difficult to balance.

A tight tolerance between the weights and the handle is preferred in manufacturing and using dumbbells. Without a tight tolerance, the weights can wear out. They will wobble and eventually rotate around the handle. The wobble and rotation will continue to worsen over time. Eventually the weights may even fall apart and injure the user. Even if the weights are not an actual danger, they may cause apprehension or otherwise distract the user. Thus, the user cannot focus solely on lifting the resistance weight and the user will not be able to obtain the full benefit of a weightlifting regimen.

U.S. Pat. No. 5,484,367 to Martinez illustrates a toy barbell set with a polycarbonate material bar that simulates the bending characteristics of steel. A key extends from the bar, and the weights and locking collars have a corresponding hole formed therein. U.S. Pat. No. 4,529,197 to Gogarty describes a dumbbell wherein the weights on either end of the handle have corresponding grooves so additional weights may be added outside of weights already attached to the dumbbell. U.S. Pat. No. 6,120,420 to Pearson et al. discloses a unitary exercise device with a light shell surrounding a denser core.

A dumbbell or barbell with a tight tolerance between the weight and the handle might be made if a weight were made entirely out of a tough, rigid material, such as steel. However, such a weight would be very expensive to manufacture. Metal casting is a simple manufacturing process which is inexpensive for forming weights. However, cast weights generally wear out. In addition, metal weights without a protective coating can mar flooring if they are dropped.

None of the prior art references teaches a weight or an exercise device that combines the benefits of a tight tolerance fit between the tough, rigid materials in the handle and in the weight, with the ease of manufacture and low cost of casting. Consequently, there is a need for taking advantage of the cost benefits of using casting in manufacturing weights. There is also a need for a weight that is well-secured to the handle and has a tight tolerance fit with a handle. There is also a need for a weight for a barbell or dumbbell that will not wear down and wobble and rotate around the handle. In addition, there is a need for exercise devices such as these that do not require locking collars.

SUMMARY OF INVENTION

The present invention provides an improved inexpensive to manufacture exercise device with secure, tight tolerance, non-rotating weights. The exercise device vastly decreases wobble and rotation of the weights around the handle and improves the wearability of weights for a barbell or dumbbell. The device is also designed to be easy and inexpensive to manufacture, and to have improved secure fitting between the weights and the handle.

The present invention is an inexpensive to manufacture exercise device with secure, tight tolerance, non-rotating weights, comprising a central handle wherein each end has a geometric shape and there is a central bore at least part way through each end, a means for securing one or more weights to the handle located at least partially within the central bore and one or more weights. It is preferred that the handle is generally cylindrical. Each weight comprises an interior element providing tight tolerance with the handle having a generally central void of a shape complementary to the geometric shape of the central handle. The geometric shape of the end of the handle is preferably generally rectangular, formed by cutting sides lengthwise into the end of the handle; however, it may alternatively be irregular.

The central bore preferably has threads, and the means for securing the weight is a locking bolt with corresponding threads. It is also preferred that there is a washer located between the interior element and the locking bolt, and that the weights have a centrally located recession on the outside surface to accommodate the washer. The handle preferably has a protrusion between the center and either end, and the weights each have a corresponding depression on the inside surface.

In the preferred embodiment, pins connect the interior element to a void generally centrally located through a resistance. The interior element and the resistance have one or more complementary apertures whereby the pins connect the interior element to the resistance. It is preferred for ease of manufacturing that the circumference of the interior element and the circumference of the void in the resistance are generally circular. It is also preferred that the pins and the interior element are made from a tight tolerance material, such as steel.

The inexpensive to manufacture, non-rotating weight for use with an exercise device of the present invention is made by making a casting of a resistance, and then drilling a hole in the center into a shape complementary to a tight tolerance interior element. The interior element is press fit into the hole. Then one or more complementary apertures are drilled so they are partly through the casting and partly through the interior element. Pins are then press fit into the apertures. A rubber outer shell and an endcap is then applied to the resistance.

The preferred method of making the exercise device of the present invention is made by making a weight as described above. After that, one or more weights is placed over each end of a central handle, wherein each end has a geometric shape complementary to the shape of the void in the interior element and also has a central bore at least partway through the handle. The weighs are then secured to the handle with a locking bolt. Preferably the central bore and the locking bolt have corresponding threads, and there is a washer between the interior element and the locking bolt.

Alternatively, the weight is formed by casting the resistance in a mold around the interior element.

Accordingly, it is a primary object of the present invention to provide an improved exercise device which can withstand vigorous usage without wearing out the weights and causing them to wobble and rotate.

It is an additional object of the present invention to provide weights, dumbbells and barbells which are inexpensive and easy to manufacture.

It is a further object of the invention to provide an exercise device that will last longer without having weights that distract a user with wobble or rotation around the handle.

It is yet another object of the present invention to form an improved weight by combining a tight tolerance interior element with a cast resistance, thereby combining the cost benefit and ease of manufacture of casting with the durability of a rigid tight tolerance fit with the handle.

It is yet still another object of the invention to secure the improved weight to the handle using a bore through each end of the handle, thereby decreasing the required width of the exercise device and making it easier for a user to handle.

It is still another object of the invention to combine the improved weight and exercise device with a rubber shell to prevent marring of flooring in case the weight is dropped.

In accordance with these and other objects which will become apparent hereinafter, the instant invention will now be described with particular reference to the accompanying drawings.

DETAILED DESCRIPTION

Figure 1:
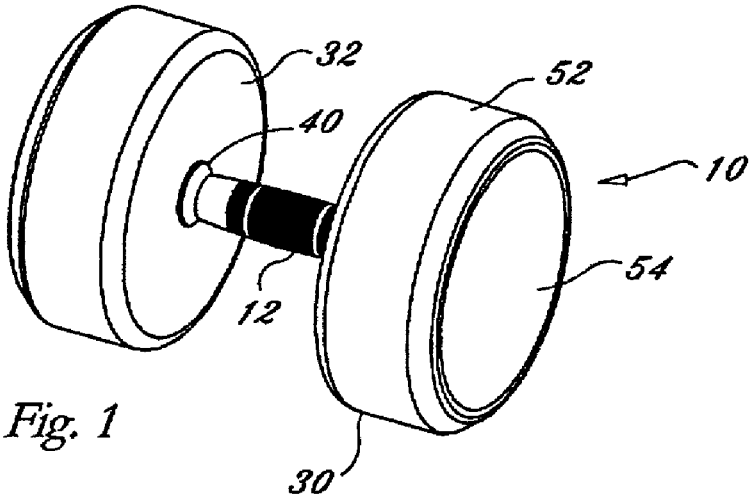
FIG. 1 is a perspective view of the preferred embodiment of the invention.
Figure 3:
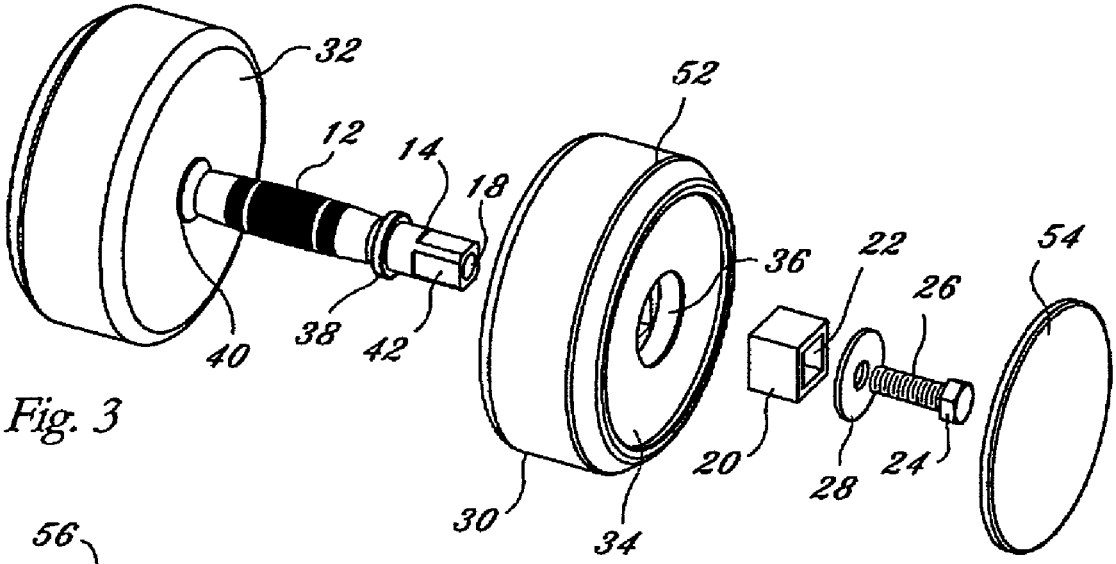
FIG. 3 is a perspective exploded view of an alternative embodiment of the invention.
Figure 4:
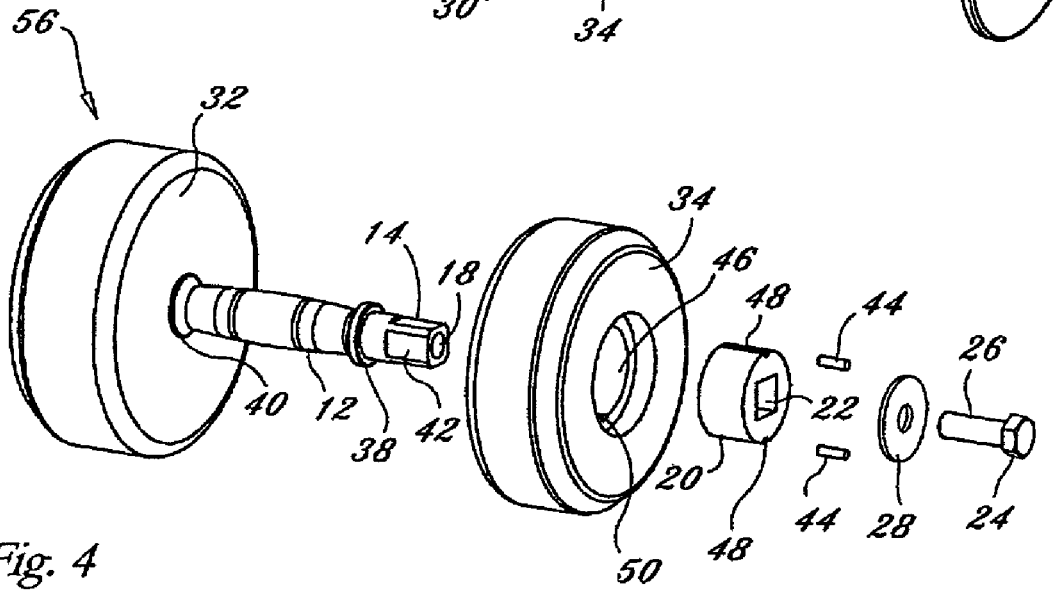
FIG. 4 is a perspective exploded view of the preferred embodiment of the invention.
Figure 2:
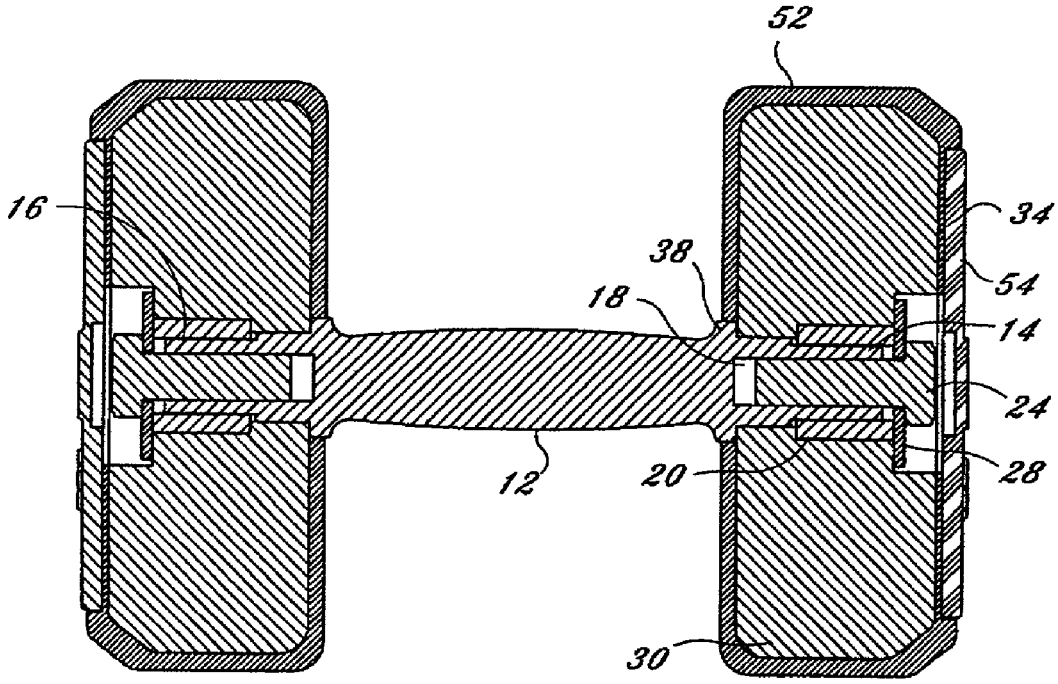
FIG. 2 is a side cross-section view of an alternative embodiment of the invention.

The invention is an inexpensive to manufacture exercise device with secure, tight tolerance, non-rotating weights, shown as 10 in FIG. 1. As shown in FIGS. 1 and 2, the inventive device comprises a central handle 12 with a near end 14 and a far end 16. The handle 12 is generally cylindrical or otherwise shaped for use as a dumbbell or barbell, and is preferably made of a tough, tight tolerance material such as steel. Each end has a geometric shape and a central bore 18 at least part way through it. While it is preferred that the shape be generally rectangular, the shape may also be triangular, hexagonal, or an irregular shape. As shown in FIGS. 3 and 4, the geometric shape is preferably formed by cutting sides 42 lengthwise into the end of the handle 12.

At least partially through each central bore 18 is located a means for securing one or more weights 56 to each end of the handle 12. Preferably, the weights 56 are secured to the handle 12 by a locking bolt 24 with threads 26, and the bore 18 has corresponding threads (not shown) within it. Also, it is preferred that a material be introduced in the threading between the bolt 24 and the bore 18 to prevent slippage, such as Locktight®. The bolt 24 is preferably made of a tough material such as steel. Other ways of securing the weight 56 to the handle 12 are well known in the art and may be used, such as lock nuts and welds.

The weight 56 is comprises an interior element 20 as shown in detail in FIGS. 2 through 6. The interior element 20 provides tight tolerance with the handle 12, and a resistance 30 having an inside surface 32 and an outside surface 34. The interior element 20 is made of a tough material such as steel. Preferably, to prevent slippage and rotation, the interior element 20 has a generally central void 22 of a shape complementary to the geometric shape of the end of the central handle 12. It is also preferred that a washer 28 with a predetermined circumference be placed between the interior element 20 and the locking bolt 24. Also, it is preferable that the washer 28 be made of a tough material such as steel.

Where the washer 28 is included, as shown in FIGS. 2 through 6, the resistance 30 includes a centrally located recession 36 on the outside surface 34. The circumference of the recession 36 is at least that of the circumference of the washer 28 so that the washer 28 seats properly.

As shown in FIGS. 2 through 5, the handle 12 further comprises a protrusion 38 between the center and either end, and the resistance 30 has a corresponding depression 40 generally centrally located on the inside surface with the protrusion 38 fitting complementarily against the depression 40. Thus, the weights 56 are prevented from sliding to the center of the handle 12.

In one embodiment, the weight 56 is formed by casting liquid metal in a mold around the interior element 20, forming one piece out of the interior element 20 and the resistance 30. Preferably, this casting is performed on clean sand with a minimum of impurities. It may be preferred that the casting is then machined to have a smooth finish without impurities, grind marks, cavities or other imperfections.

In the preferred embodiment, the resistance 30 and the interior element 20 are formed separately and they press fit together. One or more pins 44 connect the interior element 20 to a void 46 generally centrally located through the resistance 30. The interior element 20 has at least one aperture 48 at the circumference and the resistance 30 has a complementary aperture 48 located at the circumference of the void 46 in the resistance 30. Preferably, the pins 44 are press fit into the complementary apertures 48,50. It may be preferred for ease of manufacture that the circumference of the interior element 20 and the circumference of the void 46 in the resistance 30 are generally circular. It is also preferred that the pins 44 comprise a tight tolerance material, such as steel.

Figure 7:
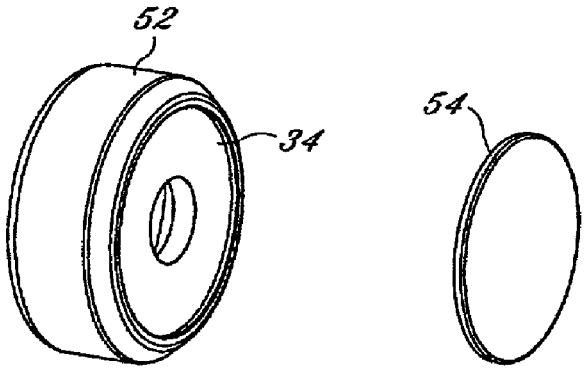
FIG. 7 is a perspective view of a detail of an alternative embodiment of the invention.
Figure 5:
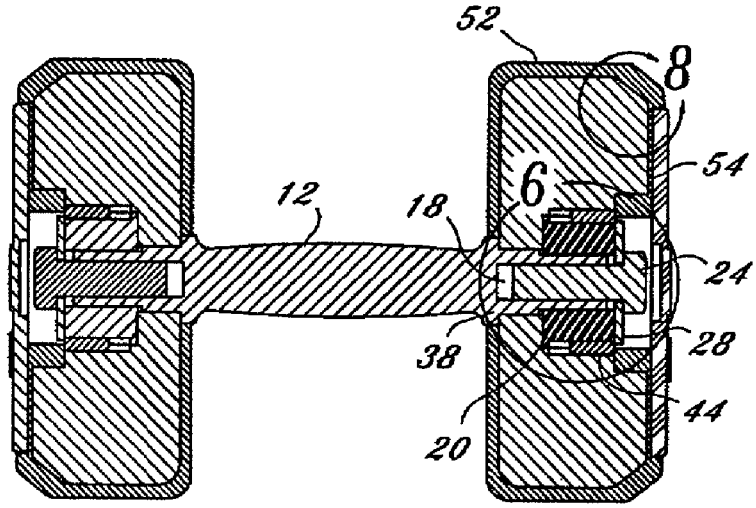
FIG. 5 is a side cross-section view of the preferred embodiment of the invention.
Figure 6:
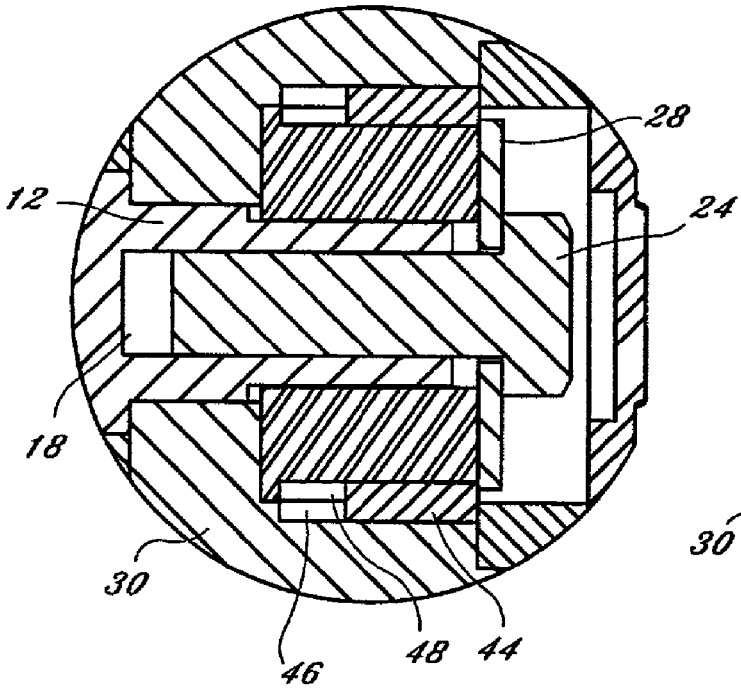
FIG. 6 is a detail of a side cross-section view of the preferred embodiment of the invention.
Figure 8:
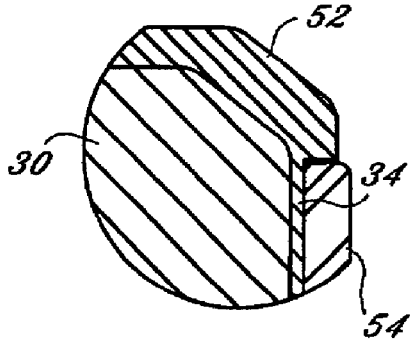
FIG. 8 is a side cross-section view of a detail of an alternative embodiment of the invention.

As shown in FIGS. 5, 7 and 8, in an alternative embodiment, after casting, a rubber shell 52 is formed around the resistance 30. It may also be preferred that an endcap 54 is attached to the rubber shell 52. The endcap 54 can be attached by means such as glue or pop rivets. The rubber shell 52 preferably covers at least a portion of the outside surface 32 of the resistance 30 where the endcap 54 may be attached to the rubber shell 52.

Figure 9:
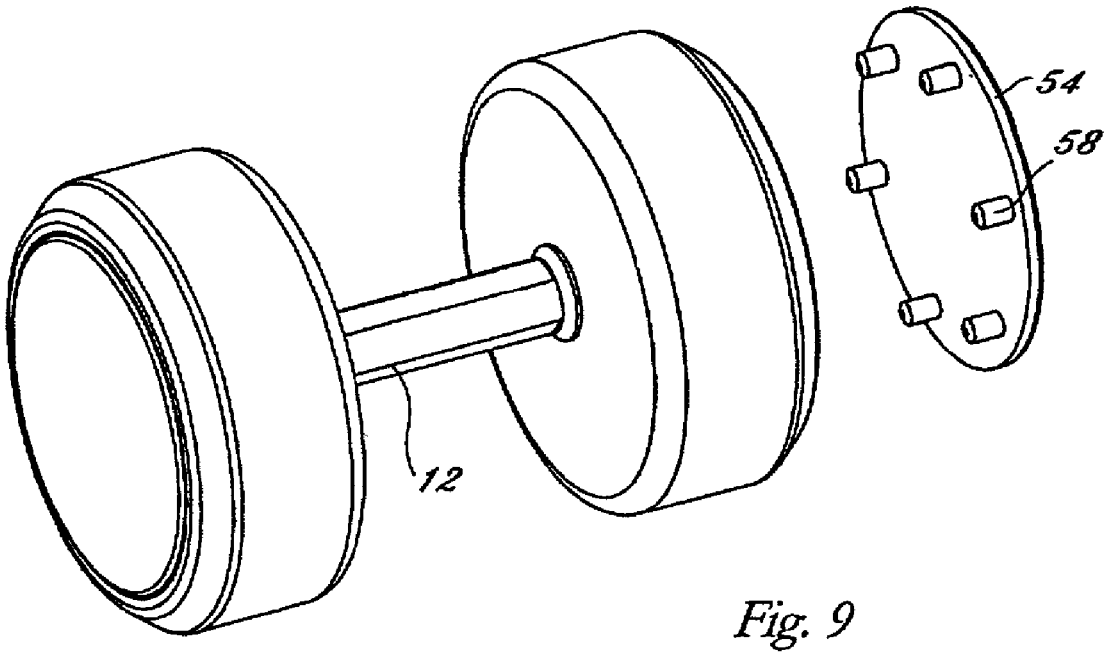
FIG. 9 is a right perspective partially exploded view of an alternative embodiment of the invention.
Figure 10:
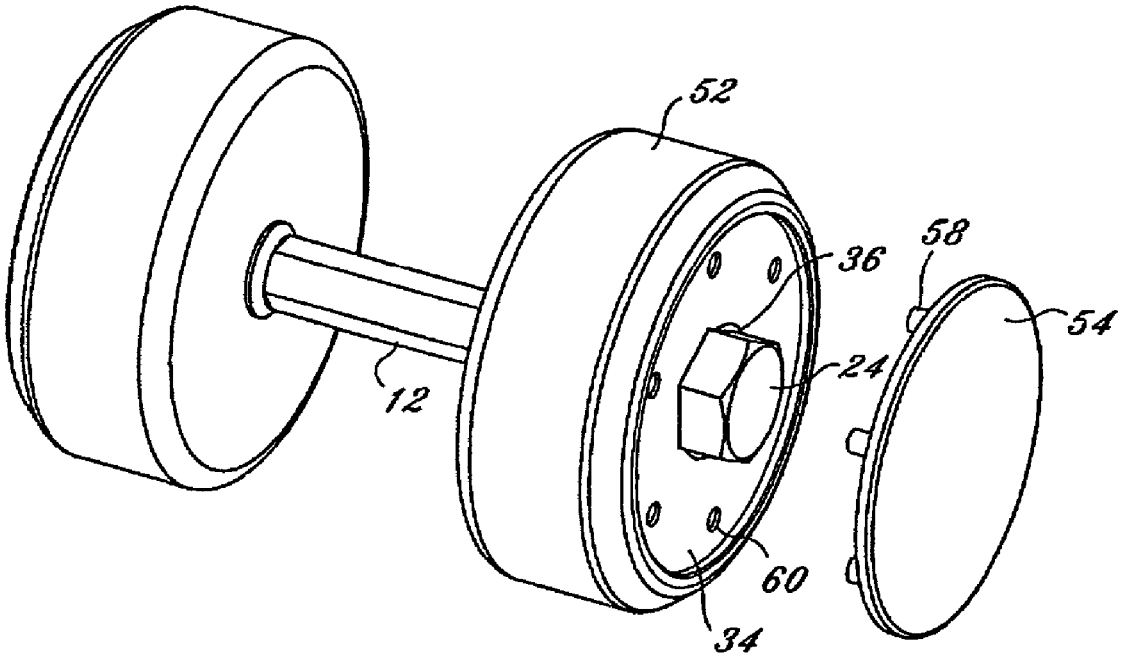
FIG. 10 is a left perspective partially exploded view of an alternative embodiment of the invention.

In another alternative embodiment, shown in FIGS. 9 and 10, the endcap 54 is more securely attached to the outer surface 34 of the resistance 30 through the use of nipples 58. The endcap 54 in this embodiment includes one or more nipples 58 formed on the interior surface of the endcap 54. It is preferred that the nipples 58 are formed intrinsically with the endcap 54, such as with an injection molding machine; however, the nipples 58 may also be added after the endcap 54 has been formed. The nipples 58 are formed so that they are complementary to voids 60 formed on the outside surface 34 of the resistance 30. The voids 60 are drilled into the outer surface 34, preferably by mill, although they may be press drilled or drilled by hand. The 60 are preferably filled with an adhesive, and then the nipples 58 are placed over the voids, thereby securing the endcap 54 over the outer surface 34. The nipples 58 may be any shape, although the preferred shape is generally cylindrical, with generally pointed ends.

The preferred method of forming an inexpensive to manufacture, non-rotating weight for use with an exercise device comprises the following steps. First, a casting of a resistance is made. A hole is drilled through the center of the resistance into a shape complementary to the circumference of a tight tolerance interior element. The interior element is then press fit into the casting. Then, one or more complementary apertures are drilled at least partway through the casting and at least partway through the interior element. Pins are then press fit into the apertures. In an alternative embodiment, a rubber shell is applied to the resistance, and an endcap is glued or pop riveted to the rubber outer shell.

Moreover, the preferred method of making an inexpensive to manufacture exercise device with secure, tight tolerance, non-rotating weights, comprising the following steps. First, a casting of a resistance is made. Then, a hole is machined in the center of the resistance into a shape complementary to the circumference of an interior element. The interior element, having a generally central void having with a predetermined geometric shape, is press fit into the hole in the resistance.

One or more apertures are drilled at least partway through the casting at the circumference of the void in the resistance and at least partway through the interior element at the circumference of the interior element. Pins are then press fit into the complementary apertures to form a weight. One or more weights are placed over each end of a central handle. Each end of the handle has a geometric shape complementary to the shape of the central void of the interior element and a central bore at least partway through the interior of the handle. The weight is then secured to the handle. Preferably, the bore has threads through it, and a locking bolt including threads which correspond with the central bore threads secures the weight to the handle. It is also preferred that a material to prevent slippage is introduced between the locking bolt and the bore, and that a washer is placed between the bolt and the interior element.

The instant invention has been shown and described herein in what is considered to be the most practical and preferred embodiment. It is recognized, however, that departures may be made therefrom within the scope of the invention and that obvious modifications will occur to a person skilled in the art.

The invention claimed is:

1. An inexpensive to manufacture exercise device with secure, tight tolerance, non-rotating weights, comprising:

a central handle with a near end and a far end, wherein each end has a non-circular geometric shape and a central bore at least part way through each end;

a means for securing one or more weights to the handle located at least partially within the central bore; and one or more weights, each comprising:

an interior element providing tight tolerance with the handle having a circumference and a generally central void of a shape complementary to the non-circular geometric shape of the central handle.

2. The exercise device of claim 1, wherein the central bore comprises threads, and the means for securing comprises:

a locking bolt including threads which correspond with the central bore threads.

3. The exercise device of claim 2, further comprising a washer with a predetermined circumference located between the interior element and the locking bolt.

4. The exercise device of claim 3, wherein the weights further comprise a resistance including a centrally located recession on the outside surface of a circumference at least that of the circumference of the washer.

5. The exercise device of claim 1, wherein the means for securing comprises welding the interior element to the end of the handle.

6. The exercise device of claim 1, wherein the handle is generally cylindrical.

7. The exercise device of claim 1, wherein the handle further comprises a protrusion between the center and either end, and the resistance has a corresponding depression generally centrally located on the inside surface.

8. The exercise device of claim 1, wherein the geometric shape of the end of the handle is generally rectangular.

9. The exercise device of claim 1, wherein the geometric shape is formed by cutting sides lengthwise into the end of the handle.

10. The exercise device of claim 1, wherein the geometric shape is irregular.

11. The exercise device of claim 1, wherein the weight is formed by casting liquid metal in a mold around the interior element.

12. The exercise device of claim 1, further comprising pins connecting the interior element to a void generally centrally located through a resistance.

13. The exercise device of claim 12, wherein the interior element and the resistance comprise one or more complementary apertures whereby the pins connect the interior element to the resistance.

14. The exercise device of claim 13, wherein the circumference of the interior element and the circumference of the void in the resistance are generally circular.

15. The exercise device of claim 14, wherein the pins comprise a tight tolerance material.

16. The exercise device of claim 15, wherein the pins are made of steel.

17. The exercise device of claim 12, wherein the interior element is made of steel.

18. The exercise device of claim 1, further comprising an endcap including at least one nipple to be placed over an outer surface of the weight, wherein the outer surface includes at least one void complementary to each nipple.

19. A method of making an inexpensive to manufacture exercise device with secure, tight tolerance, non-rotating weights, comprising the steps of:

making a casting of a resistance;

drilling a hole in the center of the resistance into a shape complementary to the circumference of an interior element;

press fitting an interior element having a circumference and a generally central void having a predetermined non-circular geometric shape into the casting;

drilling one or more apertures located at least partway through the casting and at least partway through the interior element at the circumference of the interior element;

press fitting pins complementary to the apertures into the apertures to form a weight;

placing one or more weights over each end of a central handle, wherein each end has a non-circular geometric shape complementary to the shape of the central void of the interior element and a central bore at least partway through the handle; and securing the weight to the handle through the bore at each end of the handle with a means for securing.

20. The method of claim 19, wherein the central bore comprises threads, and the means for securing comprises:

a locking bolt including threads which correspond with the central bore threads.

21. The method of claim 19, wherein the means for securing further comprises a washer located between the interior element and the locking bolt.

* * * * *